US005337032A

United States Patent [19]

Baker et al.

[11] Patent Number: 5,337,032

[45] Date of Patent: Aug. 9, 1994

[54] REDUCED COMPONENT TONER CARTRIDGE

[75] Inventors: Ronald W. Baker, Versailles; Robert L. Burdick, Nicholasville; Martin V. DiGirolamo, Lexington; Paul D. Horrall, Lexington; David L. Merrifield, Lexington; James J. Molloy, Lexington; Earl D. Ward, II, Lexington; Bernard L. Wilzbach, Lexington, all of Ky.

[73] Assignee: Lexmark International, Inc., Greenwich, Conn.

[21] Appl. No.: 23,459

[22] Filed: Feb. 26, 1993

[51] Int. Cl.[5] ..... G03G 15/06; G03G 15/08; G03G 21/00

[52] U.S. Cl. ..... 355/260; 355/200

[58] Field of Search ..... 355/245, 259, 260, 200

[56] References Cited

U.S. PATENT DOCUMENTS

| | | | |
|---|---|---|---|
| 5,012,289 | 4/1991 | Aldrich et al. | 355/260 |
| 5,085,171 | 2/1992 | Aulick et al. | 118/653 |
| 5,086,728 | 2/1992 | Kinoshita | 118/653 |
| 5,101,237 | 3/1992 | Molloy | 355/245 |
| 5,183,964 | 2/1993 | Stelter et al. | 355/259 X |
| 5,220,129 | 6/1993 | Nishio et al. | 355/259 X |
| 5,220,383 | 6/1993 | Enoki et al. | 355/259 X |
| 5,239,344 | 8/1993 | Enoki et al. | 355/259 |
| 5,245,391 | 9/1993 | Suzuki et al. | 355/259 X |

*Primary Examiner*—Fred L. Braun
*Attorney, Agent, or Firm*—John A. Brady

[57] ABSTRACT

A toner cartridge having no toner pump with the toner adding roller (11 ) positioned horizontal to the developer roller (3), the toner chamber (9) located predominantly below the developer roller, the photoconductive drum located 120 degrees from the top of tile developer roller, and the doctor blade (5) is located near the top. The cartridge has a minimal number of operational parts.

9 Claims, 1 Drawing Sheet

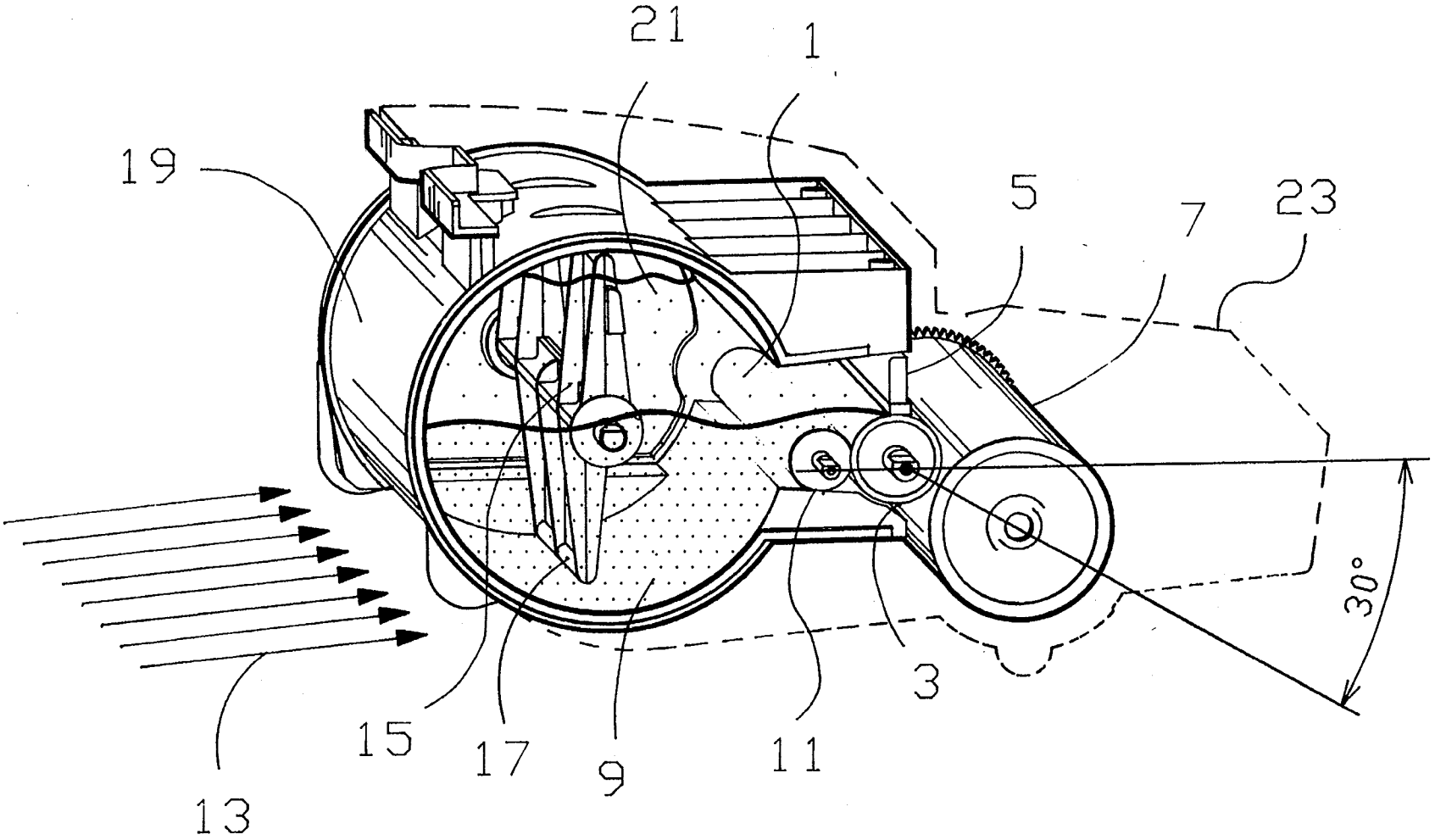
30°
23
7
5
1
21
19
3
11
9
17
15
13

REDUCED COMPONENT TONER CARTRIDGE

TECHNICAL FIELD

This invention relates to electrophotographic development and, more particularly, relates to a toner cartridge having no toner pump and associated structure.

BACKGROUND OF THE INVENTION

The toner pump is described in U.S. Pat. No. 5,012,289 to Aldrich et al. It is a device which meters toner from a chamber above the developer station. The developer station employs a toner adding roller, which is at a predetermined electrical potential higher than that of the developer roller. The toner adding roller rotates in a bed of toner in contact with the developer roller and thereby applies toner onto tile surface of the developer roller charged primarily to the same electrical sign as that of both the toner adding roller and the developer roller. The developer roller then rotates past a doctor blade which is charged to a potential higher than the developer roller and rejects much toner having the other potential (termed wrong sign toner). Such a system does not operate reliably under the pressures of a high column of toner which can reach the doctor blade-developer roller nip. The toner pump is employed to limit the toner head reaching the doctor blade-developer roller nip.

Elimination of the toner pump reduces manufacturing and material cost and unwanted pressure variations during operation caused by the operation of the pump, which have been remedied by a vent between both sides of the toner pump and by close tolerances. A two phase toner pump has also been developed to remedy this effect and is the subject of U.S. Pat. No. 5,101,237 to Molloy.

Elimination of the toner pump reduces variations in torques, since the other rollers are driven off the same power source as the toner pump. Reduction in such fluctuations can reduce jitter or, alternatively, reduces costs in powering the system adequately to avoid jitter.

U.S. Pat. No. 5,086,728 to Kinoshita shows a toner applying roller horizontal to a developer roller, but is not otherwise closely similar to this invention.

DISCLOSURE OF THE INVENTION

In the toner cartridge of this invention the primary toner chamber is located lower than the developer station. This chamber has a paddle which rotates constantly during operation, as was true with the cartridge with toner pump. In this cartridge, the paddle operation brings sufficient toner to the developing station even as the toner supply drops under the developing station. In the preferred embodiment a top half of the toner chamber exists to permit the paddle to smoothly rotate and to constrain airborne toner. However, the maximum filling of the toner chamber is to roughly the nip between the doctor blade and the developer roller.

BRIEF DESCRIPTION OF THE DRAWING

The details of this invention will be described in connection with the accompanying drawing in which the figure is an illustrative, side-perspective, cross sectioned view of the preferred cartridge in accordance with this invention.

BEST MODE FOR CARRYING OUT THE INVENTION

As seen in the drawing, the level of dry, powder toner 1 is not substantially above the nip of the developer roller 3 and the doctor blade 5. Doctor blade 5 contacts developer roller 3 substantially at the top of roller 3. In the drawing the loading of toner 1 is the maximum permitted in normal operation, and, of course, during use the amount of toner 1 will diminish. Developer roller 3 contacts photoconductive drum 7 at an angle of 30 degrees from the horizontal, which is 120 degrees from the location of contact of doctor blade 5 with roller 3. Since the toner chamber 9 occupies an area predominantly below roller 3, space is conserved by locating photoconductive drum 7 also predominantly below roller 3 (the foregoing cartridge with toner pump had a 13 degree angle).

The toner adder roller 11 is located generally horizontal with the developer roller 3 (i.e., with its nip control at 90 degrees from the top of roller 3). This position blocks excess toner from the chamber 9, and is important to reliable operation. With toner adder roller 11 physically between developer roller 3 and chamber 9, chamber 9 can extend downward more than twice the diameter of toner adder roller 11 as shown. Photoconductive drum 7 is located on the side of developer roller 3 opposite the location of toner adder roller 11. The bottom level of chamber 9 is determined by tile toner volume requirements. The paper path 13 must be lowered to clear chamber 9.

During operation, paddle 15 continually moves toner in chamber 9 by blades 17 at the outer periphery of chamber 9. The developer unit housing 19 defines chamber 9 and a corresponding upper chamber 21, to form a closed chamber of chamber 9 and chamber 21 of circular configuration in which paddle 15 turns freely. The upper chamber 21 is never filled with toner 1 and exists to capture flying toner. The lack of toner in this region is to prevent excessive toner pressure.

Operation is inherent and characterized by a minimal number of operational parts in the cartridge. Paddle 15 rotates during all operation in a simple circle, and is therefore a minimal source of torque fluctuations. Toner adder roller 11 and developer roller 3 are electrically charged and rotate in the manner of the previous cartridge having a toner pump. Doctor blade 5 is preferably the low-cost, compliant doctor blade described in U.S. Pat. No. 5,085,171 to Aulick et al. Doctor blade 5 is electrically charged but not rotated or otherwise moved directly.

It will be understood that the elements described exist across the width of the cartridge, as shown in perspective in the drawing. It will also be understood that the photoconductive drum 7 is a part of the cartridge, the elements being unified by an outer housing 23, shown in phantom outline, as is now conventional. Toner is essentially the same as that in the cartridge with toner pump now widely distributed by the assignee of this invention for the IBM LaserPrinters 4019 and 4029, and as summarized in the foregoing U.S. Pat. No. 5,012,289.

What is claimed is:

1. An electrophotographic imaging toner cartridge comprising a developer roller, a doctor blade in contact with said developer roller near the top of said developer roller, a toner applying roller in contact with said developer roller and located on substantially the same horizontal plane as said developer roller, a chamber for electrophotographic toner positioned predominantly below said developer roller and on the side of said toner applying roller away from said developer roller, said chamber extending downward from the top of said toner applying roller more than twice the diameter of said toner applying roller.

2. The toner cartridge as in claim 1 also comprising a photoconductive roller in contact with said developer roller, said photoconductive roller being positioned substantially below said developer roller.

3. The toner cartridge as in claim 2 containing dry toner in an amount to fill said chamber up to about the level of the contact of said doctor blade and said developer roller.

4. The toner cartridge as in claim 2 containing dry toner in an amount less than an amount to fill said chamber up to about the level of the contact of said doctor blade and said developer roller.

5. The toner cartridge as in claim 1 containing dry toner in an amount to fill said chamber up to about the level of contact of said doctor blade and said developer roller.

6. The toner cartridge as in claim 1 containing dry toner in an amount less than an amount to fill said chamber up to about the level of the contact of said doctor blade and said developer roller.

7. An electrophotographic imaging toner cartridge comprising a developer roller, a doctor blade in contact with said developer roller near the top of said developer roller, a toner applying roller in contact with said developer roller, the location of said contact being 90 degrees from the location of said contact of said doctor blade, a photoconductive roller in nip relationship with said developer roller, the location of said nip relationship being substantially 120 degrees from the location of said contact of said doctor blade on the side of said developer roller opposite the location of said toner applying roller, and a chamber for electrophotographic toner positioned on the side of said toner applying roller opposite said developer roller and having a predominate portion below said developer roller said chamber extending downward from the top of said toner applying roller more than twice the diameter of said toner applying roller.

8. The toner cartridge as in claim 7 contained dry toner in an amount to fill said chamber up to about the level of contact of said doctor blade and said developer roller.

9. The toner cartridge as in claim 7 containing dry toner in an amount less than an amount to fill said chamber up to about the level of the contact of said doctor blade and said developer roller.

* * * * *